US006095200A

United States Patent [19]

Hellstroem

[11] Patent Number: 6,095,200

[45] Date of Patent: Aug. 1, 2000

[54] OPTO-ELECTRONIC SENSOR DEVICE FOR A YARN FEEDER

[75] Inventor: Jerker Hellstroem, Nol, Sweden

[73] Assignee: IRO AB, Ulricehamn, Sweden

[21] Appl. No.: 09/155,704

[22] PCT Filed: Mar. 25, 1997

[86] PCT No.: PCT/EP97/01524

§ 371 Date: Dec. 17, 1998

§ 102(e) Date: Dec. 17, 1998

[87] PCT Pub. No.: WO97/37247

PCT Pub. Date: Oct. 9, 1997

[30] Foreign Application Priority Data

Apr. 1, 1996 [DE] Germany ..... 196 12 953

[51] Int. Cl.[7] ..... G01V 8/14; D03D 47/36; B65H 51/22; D04B 15/48

[52] U.S. Cl. ..... 139/452; 242/563; 242/364.8; 356/429; 250/559.4

[58] Field of Search ..... 139/452; 250/559.4, 250/559.44; 242/563, 364.8; 356/429

[56] References Cited

U.S. PATENT DOCUMENTS

| | | | |
|---|---|---|---|
| 4,083,506 | 4/1978 | Mander et al. | 242/25 R |
| 4,163,158 | 7/1979 | Coughenour et al. . | |
| 4,865,085 | 9/1989 | Ghiardo . | |
| 5,211,121 | 5/1993 | Sakakibara | 112/278 |
| 5,221,960 | 6/1993 | Akerlind et al. | 356/429 |

FOREIGN PATENT DOCUMENTS

| | | |
|---|---|---|
| 0 199 059 A1 | 10/1986 | European Pat. Off. . |
| 0 199 059 B1 | 10/1986 | European Pat. Off. . |
| 2 588 385 | 4/1987 | France . |
| 2 153 950 | 5/1973 | Germany . |
| 47 07 332 A1 | 9/1993 | Germany . |
| 195 25 260A1 | 1/1997 | Germany . |

*Primary Examiner*—Andy Falik
*Attorney, Agent, or Firm*—Flynn, Thiel, Boutell & Tanis, P.C.

[57] ABSTRACT

An opto-electronic device (S) for detecting the movement of yarn (Y) (10) passing transversely through a detection zone (11) on the storage drum (3) of a yarn feeder (F), has at least one light source (L) directed on the detection zone (11), at least one reflector (B) fitted on the storage drum (3) a short distance away on the side of the detection zone (11) away from the light source (L) and at least one signal-generating receiver (R) directed towards the detection zone. The opto-electronic device also has a reflector which includes (B) at least one narrow and approximately flat reflection area (15, 15', 15") extending essentially parallel to the longitudinal direction of the yarn and in the circumferential direction of the storage drum (3). The reflection area is bounded at its longitudinal sides by either a strip diaphragm fitted between the reflector (B) and the yarn passage plane (13), or diaphragmed regions (17) arranged approximately in the reflector plane.

20 Claims, 2 Drawing Sheets

OPTO-ELECTRONIC SENSOR DEVICE FOR A YARN FEEDER

FIELD OF THE INVENTION

The present invention relates to an opto-electronic device provided on a storage drum of a yarn feeder for detecting a yarn in a detection zone.

BACKGROUND OF THE RELATED ART

In a device of this kind known from EP-A-0 199 059, the light source and the receiver pointing into the detection zone at the storage drum are provided in a bracket of the housing of the yarn feeder and distant from the surface of the storage drum. Below the detection zone a glass plate is inserted into the surface of the storage drum. At the lower side of said glass plate a full plane reflective coating is provided. The yarn windings wound onto the storage drum in circumferential direction are pushed axially forwards so that each yarn winding passes the detection zone lateral to its longitudinal direction. The device serves as a sensor for the detection of the axial position of at least the first winding of the yarn supply on the storage drum and is responding to the movement, absence or presence of the yarn with a signal which, e.g., is used for the control of the rotational drive of the yarn feeder. The receiver exclusively registers the shade of the yarn or the variation of the light intensity as soon as the yarn is interrupting the light beams directed towards the reflector or coming from the reflector. Independent from the design, only a relatively weak modulation of the signal can be derived from the shadowing, particularly in case of thin yarns, such that in order to generate a useful and clear active signal relatively high efforts are necessary for the evaluation, amplification and discrimination. The device is vulnerable in case of dirt, disturbing light or unavoidable lint or lint bundles. In addition, the frequency of necessary cleaning—or maintenance—cycles is undesirably high.

It is, nevertheless, for similar devices known to provide a diaphragm and/or lenses for an opto-electronic yarn detection between the yarn and the receiver and/or between the light source and the yarn. However, that measure cannot significantly improve the response behavior of the device and does not have a considerable influence on the vulnerability against contamination.

It is an object of the invention to create a device of the kind as disclosed which is apt to derive strong and useful effective signals from the passage of the yarn through or the presence or absence of the yarn in the detection zone, which is relatively insensitive for contaminations, lint and disturbing light.

SUMMARY OF THE INVENTION

The object of the invention is achieved by providing the opto-electronic sensor device of the invention with a reflector having a narrow reflection area which extends in a circumferential direction of the storage drum.

As the yarn, even with its relatively slow forward motion on the storage drum, covers or clears at least one bar-code-shaped reflection-area extending in longitudinal direction of the yarn, relatively quickly, i.e. only very short time is expiring till maximum coverage or complete clearing, very strong and effective use-signals are generated. The narrow but long reflection zone is illuminated during absence of the yarn over its full length and width and is reflecting, due to its large longitudinal extension, much light to the receiver. When the yarn is present between the reflection-strip and the light source, it may happen that the entire reflection strip is covered. Due to the bar-code shape and the small width of the reflection-strip in moving direction of the yam, there is not only a strong difference in the light amount between the covered and the cleared conditions but also a strong and progressive or degressive transition from high light amount to low light amount and vice versa. The strong signal-modulation occurring therewith allows to avoid high electronic efforts for the signal evaluation. The response behavior is hardly changed by uniform and weak contamination. Lint or lint bundles can normally not shadow or clear the reflection zone in the same way as the yarn and for this reason, are almost uncritical for the derivation of correct effective signals.

Such advantageous properties also result, from a width of the long reflection area approximately corresponding to the dimensional order of the thickness of the strongest processed yarns.

Said advantageous response behavior either is achieved with a diaphragm-like operating strip-shaped reflection zone of the reflector, or with a strip diaphragm having at least one strip-shaped diaphragm aperture which optically defines the reflection area at the reflector and efficiently uses the distance between the detection zone and the reflector. At least one reflection area decisive for the receiver is, in other words, optically formed on a much bigger reflector surface by means of said diaphragm aperture of the strip diaphragm or without a diaphragm aperture only bounded by the length side, non-reflecting zones. Since with the optical limiting of the reflection strip by means of the strip diaphragm, adjacent areas of the reflector are not used for reflecting purposes already. By means of a strip diaphragm only at least one bar-code-shaped reflection area could be used.

In the embodiment wherein a distance is defined between the strip diaphragm and the reflection strip, a focal-depth adjustment can optionally be preset. For the diaphragm function, the distance between the light source and the diaphragm aperture or between the receiver and the diaphragm aperture is of secondary importance, since the diaphragm aperture is situated at the side of the yarn facing the reflector.

Another embodiment is advantageous, because it is provided with at least two parallel and separated diaphragm apertures in said strip diaphragm. The yarn passing through the detection zone is interrupting the light path two fold, and each time in almost exactly the same manner.

In the embodiment which is operating without a strip diaphragm, several, i.e. two, reflection areas with intermediate non-reflecting zones are provided so that the yarn during its passage is registered by the receiver so to speak, in steps and very clearly. The receiver is recognizing the passage across each reflection area at least once and forcefully, since the same yarn so to speak, twice approaches from infinity and vanishes into infinity as soon as it is above said zone.

In the embodiment wherein the reflection areas and zones have the same width and form regular strip pattern, a multiple-forceful signal modulation is achieved in steps. The strip pattern is designed so that it can be used for all available yarn qualities or yarn thicknesses.

For practical employment, a dimensioning is useful.

As the storage drum of a yarn feeder, particularly a stationary storage drum, is hindered by means of mutually cooperating magnets or a ballast weight against co-rotation with the rotating drive shaft supporting said storage drum during operation of said yarn feeder, rotational oscillations of the storage drum nevertheless cannot be avoided. A possibly weak curvature of at least the reflection area is apt to avoid a disturbing influence of such rotational oscillations, since then the reflection area is maintaining its reflecting-properties even under rotational oscillations of the storage drum (having a diameter of approximately 90 mm or more).

The embodiment wherein a light exiting direction of the light source is in a radial plane at an acute angle with a radius to the light source is of particular advantage. The yarn is passing the light path twice, i.e. across the diaphragm apertures of the strip diaphragm. The receiver is responding by forceful and effective use-signals, when firstly the light path into the reflection area is interrupted and then the light path from the reflection area to the receiver. The reflection area in this case is directed to the light source and the receiver. Both, accordingly, are positioned accordingly inclined.

In this alternative embodiment, a forceful signal modulation is generated, since the yam is covering and clearing each reflection area quickly and, what is important, with a sharp transition between the maximum covering and the maximum clearing.

The embodiment having a light permeable plate is structurally simple. The light permeable plate functions as carrier of the reflection area and of said zones and also limits by its surface the detection zone.

In the embodiment having the light permeable plate, the strip diaphragm having at least one diaphragm aperture is provided at the surface of the plate or closely below said surface, while the reflector or each reflection area is provided deeply inside the plate or even at the plate's lower surface. The spatial inter-relationship between the detection zone, the strip diaphragm and the reflector or the reflection area in this case, is optimized and predetermined. Of course, the adjustments and the distance to the light source and to the receiver have to be matched with these given prerequisites in order to guarantee an optimum response behavior of the receiver.

The embodiments wherein the plate thickness is between 3.0 and 10.0 mm, the plate width is about 10 to 30 mm, and a longitudinal extension of the plate is about 10 mm or more are of useful importance.

In the embodiment wherein the upper surface of the plate includes a plurality of diaphragm apertures, the thickness of the plate determines the distance between the strip diaphragm and the continuous reflector, only strip-shaped reflection areas of which are used according to the optical limitation by means of the diaphragm apertures of said strip diaphragm. The diaphragm apertures are kept clean by the yarn sliding across the strip diaphragm. The reflector there is protected against contamination.

The embodiment wherein the lower surface of the plate includes the reflection area is simply to manufacture.

Where the plate is movably positioned by a holder on the storage drum, a precise positioning and an easy replacement of the plate can be achieved.

BRIEF DESCRIPTION OF THE DRAWINGS

Embodiments of the invention will be described with the help of the drawings. In the drawings is.

DETAILED DESCRIPTION

Figure 1:
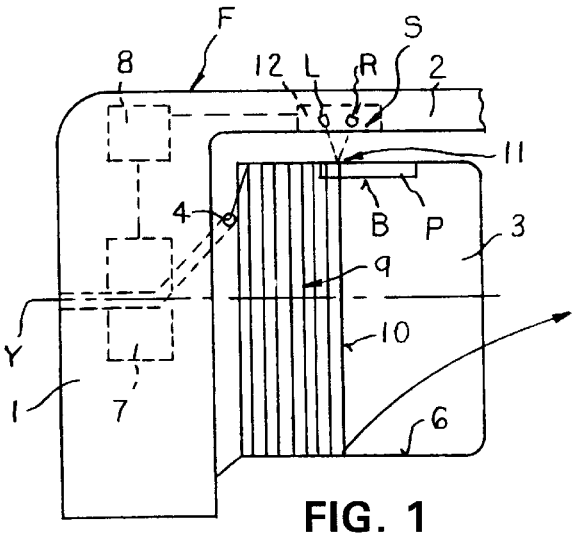
FIG. 1 is a schematic side view of a yarn feeder having a device for the detection of the movement, presence or absence of a yarn in a detection zone, FIGS. 2A,B are two schematic views associated to each other of a first embodiment of the device, FIGS. 3A,B are two associated schematic views of a further embodiment.

A yarn feeder F, as conventionally used for supplying a textile machine, e.g. a weaving machine with a left yarn, is provided with a stationary housing 1 and a housing bracket 2. At housing 1 a storage drum 3 is stationarily provided on a drive shaft indicated by its axis 5. The incoming yarn Y enters the housing 1 from the left side through a hollow section of said drive shaft in FIG. 1, and is wound by means of a rotatably driven winding element 4 in an adjacent, preferably separated, yarn windings 9 onto the surface 6 of said storage drum in order to form an intermediate yarn store or yarn supply. Said yarn then is withdrawn by said textile machine overhead of said storage drum 3 depending on consumption. In housing 1 a drive motor 7 for said winding element 4 is received which is controlled by a control device 8. Said control device 8 is receiving control signals from a device S (yarn sensor) provided in housing bracket 2. Drive motor 7 for example is controlled such that the yarn Y is wound onto the storage drum 3 until the first winding 10 in withdrawal direction is reaching a detection zone 11. Then the drive motor 7 is stopped or decelerated and will only then be accelerated again as soon as said detection zone has been cleared by said yarn again.

Said device S contains at least one light source L and at least one signal generating receiver R (light diode or photo transistor), both of which are integrated into a switching circuit 12. A reflector B is provided countersunk below the surface 6 of said storage drum 3 which reflects light emitted by said light source L towards receiver R. Advantageously, said reflector is situated at a light permeable plate P inserted into the surface 6 of said storage drum 3 such that its outer surface is flush with surface 6. The plate P or the reflector B, respectively, can be curved with the weak circumferential curvature of the storage drum 3.

Figure 2A:
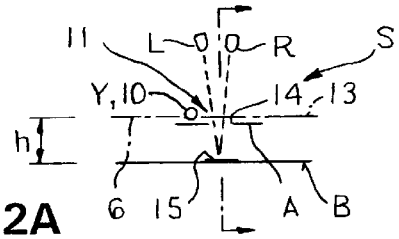
Figure 2B:
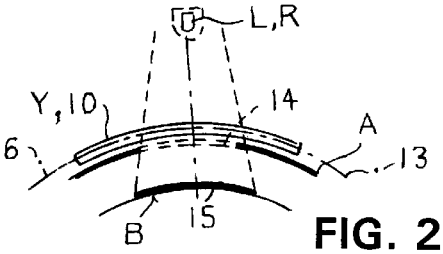

In the first embodiment of device S according to FIGS. 2A and 2B, a yarn passage plane 13 exists in detection zone 11 which passage plane 13 may correspond to the surface 6 of storage drum 3. Within said yarn passage plane 13 or first below it, a strip diaphragm A is located having a strip-shaped diaphragm aperture 14 extending essentially in circumferential direction and having a longitudinal extension which is considerably bigger than i.e., is a multiple of its width seen in the direction of axis 5 of storage drum 3. With the distance h below said yarn passage plane 13, or below strip diaphragm A, respectively, said reflector B is situated of which only an optically defined bar-code-shaped reflection-area 15 is used as defined by said diaphragm aperture 14. The width of said diaphragm aperture 14 essentially corresponds to the biggest available yarn thickness, i.e. it may even be somewhat bigger or somewhat smaller. In the circumferential direction, said diaphragm aperture 14 or the reflection area 15, respectively, has a longitudinal extension between about 8 and 20 mm. The light exiting direction of the light source L is approximately radial to axis 5 and runs somewhat inclined in the radial plane containing axis 5 such that the reflected light from reflection area 15 can hit the receiving surface of receiver R which is positioned on the same plane and with an according inclination. The distance between the light source and the yarn passing plane 13 or the strip diaphragm A, respectively, as well as the distance h between strip diaphragm A and reflector B are selected so that during passage of the yarn, across diaphragm aperture 14, a sufficiently strong signal modulation is achieved in receiver R.

Figure 3A:
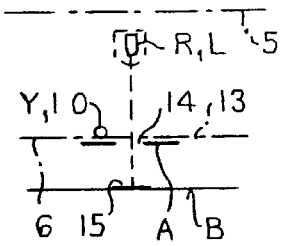
Figure 3B:
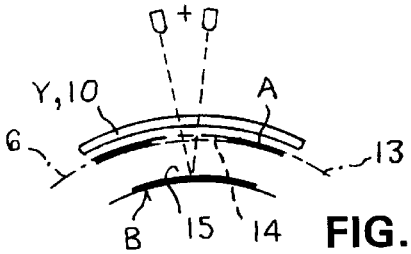

In the embodiment of FIGS. 3A and 3B, the receiver R and the light source L are aligned radially to the axis 5 of storage drum 3 but are located circumferentially offset to each other. The arrangement of strip diaphragm A and reflector B with its reflection area 15, correspond to the arrangement of FIGS. 2A and 2B.

Figure 4:
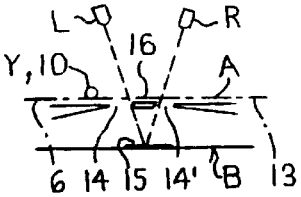
FIG. 4 is a further embodiment seen in a circumferential direction of the storage drum.

In the embodiment of FIG. 4 the light source and the receiver are similarly provided as in FIGS. 2A and 2B. In order to carry out a differential-evaluation, two light sources and/or two receivers R could be provided as well. In this embodiment strip diaphragm A has two strip-shaped diaphragm apertures 14, 14' separated from each other by means of a non-reflecting zone 16, wherein said diaphragm aperture 14 optically defines the reflection area 15 on reflector B. The light exit direction of light source L is directed such that the reflection light coming from reflection zone 15 may hit the receiver R. During its passage (in FIG. 4 e.g. from left to right), the yarn Y, 10 is blocking the beam path twice.

Figure 5:
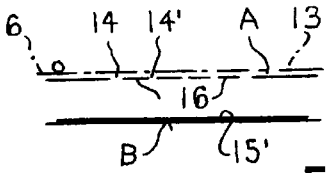
FIG. 5 is a further embodiment seen in the circumferential direction of the storage drum FIGS. 6A,B are two associated schematic views of a further embodiment.

In the embodiment of FIG. 5, the strip diaphragm A has even more than two diaphragm apertures 14, 14' separated by non-reflecting zones 16 from another. The reflector B extends continuously but is optically subdivided into several reflection areas 15'. Said diaphragm apertures 14, 14' are of the same width. Said zones 16 have a width which is adapted to the inclination of the light exit direction from the light source. Advantageously, said zones 16 are of the same width among another.

Figure 6A:
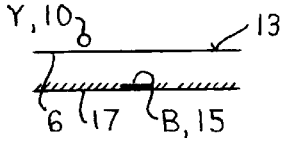
Figure 6B:
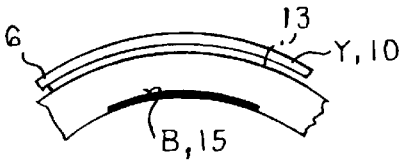

In the embodiment of FIGS. 6A and 6B the reflection area 15 of the reflector B is made as a bodily narrow strip essentially extending in circumferential direction. At both sides of reflection area 15, non-reflecting zones 17 are provided. A strip diaphragm is not used.

The non-reflecting zones as explained in connection with the above explained embodiments can be designed randomly, provided that they absorb incoming light or reflect incoming light in no case towards receiver R.

Figure 7:
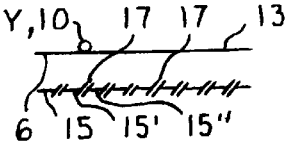
FIG. 7 is a further embodiment seen in the circumferential direction of the storage drum.

In the embodiment according to FIG. 7, in axial direction of said storage drum, several reflection areas 15, 15' 15" are provided in a parallel array with a distance below said yarn passage plane 13. Two adjacent reflection areas are separated from each other by a non-reflecting zone 17 having strip form.

Figure 8:
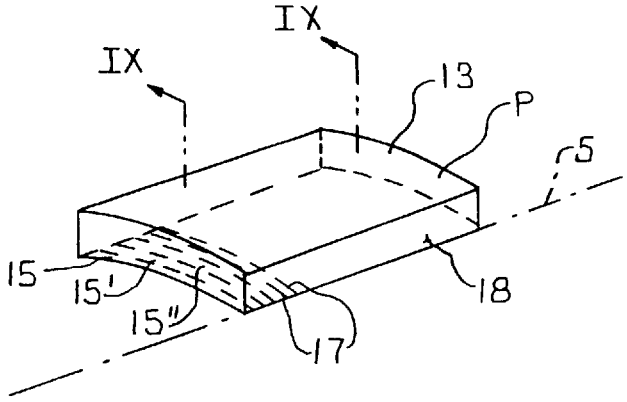
FIG. 8 is a perspective view of a detail of the device.
Figure 9:
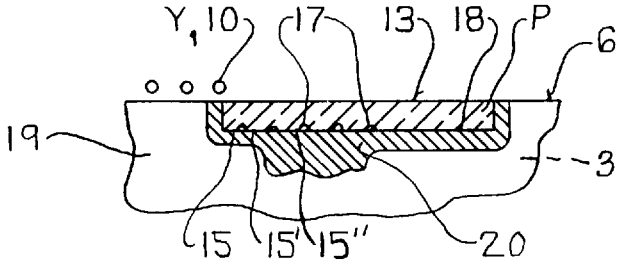
FIG. 9 is a section in plane IX—IX in FIG. 8, and FIGS. 10A,B are detailed variants in a section according to the section of FIG. 9.

FIGS. 8 and 9 show an embodiment in which the reflection areas 15, 15', 15" are situated in a light permeable plate P, e.g. made from glass or plexi-glass. The upper surface of said plate, which according to FIG. 1 is countersunk in storage drum 3, defines said yarn passage plane 13. The reflection areas 15, 15', 15" are situated at, or close to, the lower side 18 of plate P and extend in circumferential direction of storage drum 3, the axis of which is indicated by 5. In the section of FIG. 9 it can be seen that the reflection areas 15, 15', 15" are bodily integrated into the plate P or its lower side 18, respectively, and are separated from each other by zones 17 in strip-shape. A preferably regular strip pattern of reflection area strips 15, 15', 15" and diaphragmed zones 17 are formed which extend either over the entire length of plate P or at least over a limited axial portion of plate P. Plate P is received in a holder 20 mounted into storage drum 3 and can be replaced. In case that storage drum 3 is formed as a so-called rod cage comprising a plurality of rods 19, said holder 20 advantageously is situated in one of said rods 19.

Figure 10A:
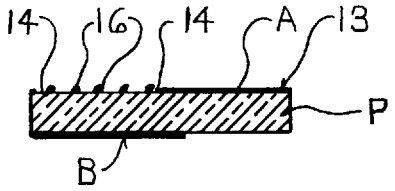

Alternatively, said plate according to FIG. 10A (corresponding to the embodiment of FIG. 5) could be provided at its lower side with a continuous reflector B (a reflective coating), while at the upper side a strip diaphragm A with its diaphragm apertures 14 and the intermediate zones 16 is situated. Within strip diaphragm A at least two diaphragm apertures 14, 14' are provided.

Figure 10B:
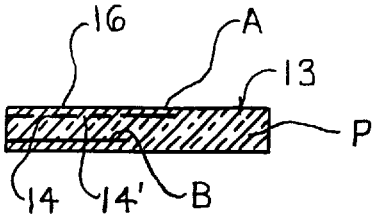

In the embodiment of FIG. 10B, which functionally corresponds to the embodiment of FIG. 10A, the strip diaphragm A is situated with its diaphragm apertures 14, 14' and its zones 16 below the upper surface of plate P inside of it, and with a distance to the reflector B, which is provided inside the plate P as well.

Plate P of FIG. 9 can be made such that at its lower surface 18, a continuous reflective coating is firstly brought up, at least in the axial portion in which later the reflection areas 15, 15', 15" will be needed. Then the zones 17 are formed by etching, grinding or cutting and may be filled by light absorbing material (black). It is also possible to first form the grooves or structures which will, at a later stage, define zones 17, and then to coat the remaining smooth lower surface portions with reflective coatings then forming said reflection areas 15, 15', 15". In this case, advantageously, first a ring of light permeable material is formed, the inner surface of which is finish treated with said reflection areas 15, 15', 15" and the zones 17. Following this, the ring is subdivided in single sections, each of which is then forming one of the plates P of FIGS. 8 and 9.

I claim:

1. In an opto-electronic device for detecting the movement, absence or presence of a yarn in a detection zone, respectively, a yarn feeder being provided which includes a storage drum having said yarn thereon, said detection zone being defined on said storage drum wherein said yarn passes said detection zone laterally relative to a longitudinal direction of said yarn, said opto-electronic device comprising at least one light source directed from outside of said storage drum towards said detection zone, at least one reflector fitted to the storage drum at a distance from a side of the detection zone which is opposite to said light source, and at least one signal generating receiver which is disposed outside of said storage drum and is directed towards the detection zone, comprising the improvement wherein said reflector has at least one bar-code-shaped reflection area which has a narrow width in a direction of movement of said yarn or in an axial direction of said storage drum, respectively, and which has a longitudinal extension that extends in a circumferential direction of said storage drum, said longitudinal extension having a length which is a multiple of said narrow width.

2. A device according to claim 1, wherein said reflection area is formed with said narrow width being dimensioned with an order of thickness corresponding to a thickest width of said yarn which is available for processing.

3. A device according to claim 1, wherein said reflection area has longitudinal sides which extend in said circumferential direction of said storage drum, said reflection area having a border which is optically defined by a strip diaphragm wherein said strip diaphragm is disposed between said reflector and a yarn passing plane through which said yarn passes, said yarn passing plane being substantially parallel to said reflector.

4. A device according to claim 1, wherein said reflection area is bordered by non-reflecting zones.

5. A device according to claim 3, wherein said strip diaphragm is disposed closer to said yarn passing plane than to said reflection area wherein said strip diaphragm is disposed in said yarn passing plane such that said yarn slides over said strip diaphragm.

6. A device according to claim 3, wherein said strip diaphragm has a plurality of parallel diaphragm apertures separated from each other by non-reflecting zones, said strip diaphragm optically defining a corresponding plurality of said reflection areas at said reflector.

7. A device according to claim 6, wherein the width of each said reflection area and/or each said diaphragm aperture of said strip diaphragm is between about 0.3 and 1.5 mm.

8. A device according to claim 3, wherein a light exiting direction of said light source runs oblique to an axis of said storage drum in a plane which contains said axis of said storage drum, said strip diaphragm including at least two diaphragm apertures which are disposed parallel to each other and are separated in an axial direction of said storage drum by a non-reflecting zone, said reflection area being associated with said diaphragm apertures wherein one of said diaphragm apertures defines a light entrance and another of said diaphragm apertures defines a light exit.

9. A device according to claim 3, wherein said strip diaphragm and said reflection area are curved so as to have a curvature which is essentially the same as a weak curvature of a surface of said storage drum.

10. A device according to claim 9, wherein said plate is movably positioned in a holder situated in said storage drum so as to the replaceable, turnable or shiftable.

11. A device according to claim 4, wherein a plurality of said reflection areas are provided with intermediate strip shaped non-reflecting zones disposed therebetween, said reflection areas being substantially parallel to each other.

12. A device according to claim 11, wherein said reflection areas and said non-reflecting zones have the same width and form a regular strip pattern.

13. A device according to claim 1, wherein a light exiting direction of said light source is situated in a radial plane of said storage drum and defines an acute angle with a radius that extends to said light source.

14. A device according to claim 1, wherein a light permeable plate is counter sunk into a surface of said storage drum, said light permeable plate having an outer surface which defines said detection zone and a yarn passing plane through which said yarn passes, said reflection area being situated inside said light permeable plate or at a lower surface of said light permeable plate.

15. A device according to claim 1, wherein a light permeable plate is counter sunk into a surface of said storage drum, an outer side of said plate defining said detection zone and a yarn passing plane through which said yarn passes, said strip diaphragm being located at an upper surface of said plate or just below said upper surface so as to be inside said plate, said reflector or each said reflection area, respectively, being situated deeper inside said plate or at a lower surface of said plate.

16. A device according to claim 14, wherein said plate has a thickness between 3.0 and 10.0 mm and is curved with a curvature that is the same as a curvature of said surface of said storage drum.

17. A device according to claim 14, wherein said plate has a width in a circumferential direction of about 10 to 30 mm and has a longitudinal extension of more than 10 mm in said axial direction of said storage drum.

18. A device according to claim 14, wherein said lower surface of said plate includes said reflection area, said lower surface being essentially plain or smooth and including a reflective coating which defines said reflection area, non-reflecting zones being formed between said diaphragm apertures by roughened, structured, excavated or etched area portions in said lower surface of said plate.

19. A device according to claim 15, wherein said lower surface of said plate includes a longitudinal extension, about 10 mm which extends in an axial direction, said longitudinal extension including a strip pattern of said reflection areas and non-reflecting zones which are disposed in alternating relation.

20. A device according to claim 15, wherein said strip diaphragm defines diaphragm apertures and said upper surface on said plate includes a plurality of said diaphragm apertures which are separated from each other in substantially parallel relation, said lower surface of said plate including said reflector which is continuous.

* * * * *

UNITED STATES PATENT AND TRADEMARK OFFICE

CERTIFICATE OF CORRECTION

PATENT NO. : 6,095,200
DATED : August 1, 2000
INVENTOR(S) : Jerker Hellstroem

It is certified that error appears in the above-identified patent and that said Letters Patent is hereby corrected as shown below:

Column 7;
Line 36, change "claim 9" to -- claim 14 --.

Signed and Sealed this

Eleventh Day of September, 2001

*Attest:*

Nicholas P. Godici

*Attesting Officer*

NICHOLAS P. GODICI
*Acting Director of the United States Patent and Trademark Office*